United States Patent [19]

Lennon et al.

[11] 4,156,036

[45] May 22, 1979

[54] STRUCTURED DONOR SHEET FOR HIGH-RESOLUTION NON-IMPACT PRINTER

[75] Inventors: Donald J. J. Lennon, Acton; Roger E. Clapp, Cambridge, both of Mass.

[73] Assignee: EPP Corp., Boston, Mass.

[21] Appl. No.: 710,283

[22] Filed: Jul. 30, 1976

[51] Int. Cl.[2] ..... B05D 3/14

[52] U.S. Cl. ..... 427/47; 427/123; 427/127; 427/129; 427/131; 427/132; 427/197; 427/201; 427/203; 427/204; 427/262; 427/265; 427/328; 427/330

[58] Field of Search ..... 427/47, 25, 18, 48, 427/128, 148, 309, 337, 457, 469, 539, 123, 127, 129, 131, 132, 197, 201, 203, 204, 262, 265, 328, 330

[56] References Cited

U.S. PATENT DOCUMENTS

| | | | |
|---|---|---|---|
| 3,128,544 | 4/1964 | Allingham | 427/47 X |
| 3,391,455 | 7/1968 | Hirohata et al. | 427/123 X |
| 3,503,783 | 3/1970 | Evans | 427/123 X |
| 3,584,601 | 6/1971 | Turner | 118/637 |
| 3,849,161 | 11/1974 | Klaenhammer | 317/262 A |

*Primary Examiner*—Bernard D. Pianalto
*Attorney, Agent, or Firm*—Kenway & Jenney

[57] ABSTRACT

Structures for supporting printing particles in spaced aggregates as mounds and towers, for use in pulsed electrical printers, and method for their production. The structures comprise a base sheet having a roughened or microcavernous surface to receive the printing particles. The base sheet may be formed of or coated with conductive material, and may comprise a magnetizable material useful in forming and retaining the aggregates.

9 Claims, 7 Drawing Figures

FIG. 1
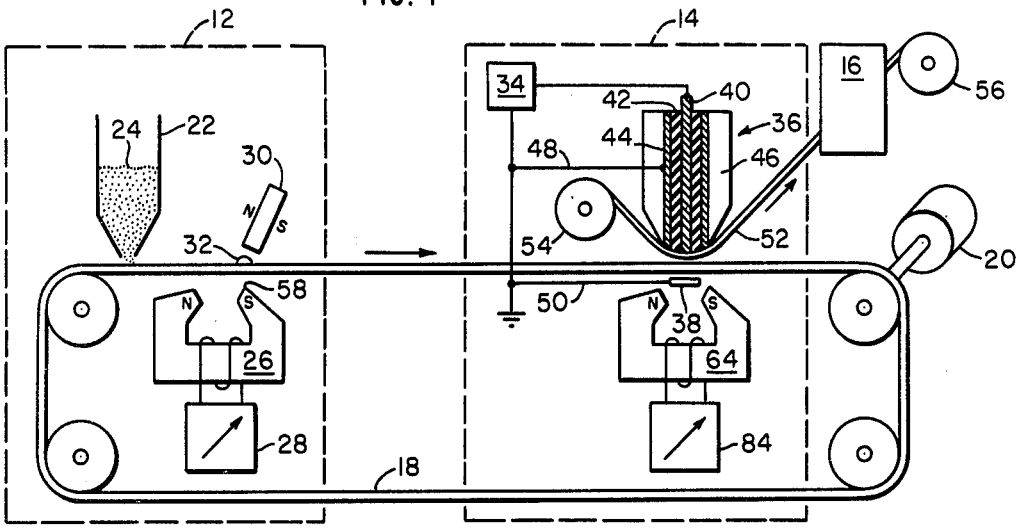
FIG. 1A
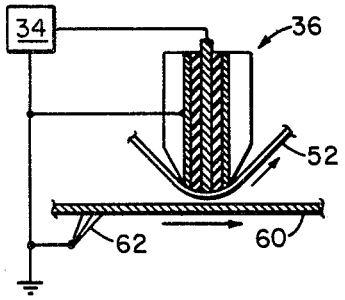
FIG. 2
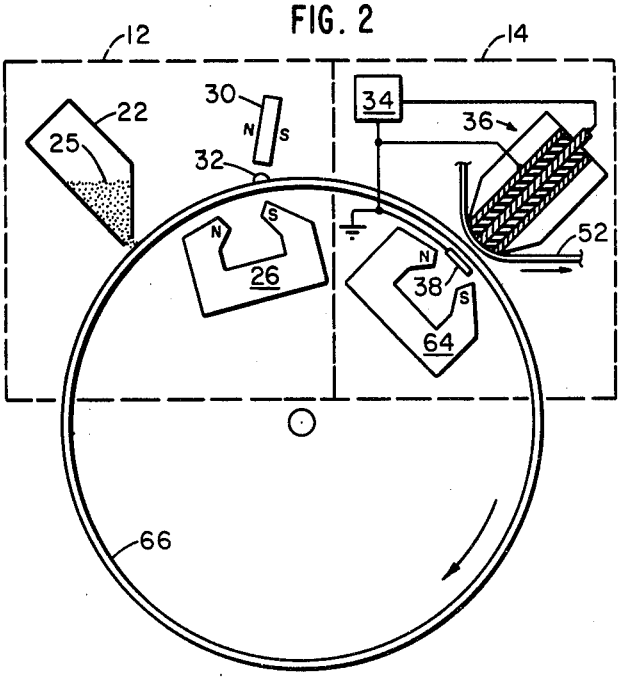
FIG. 2A
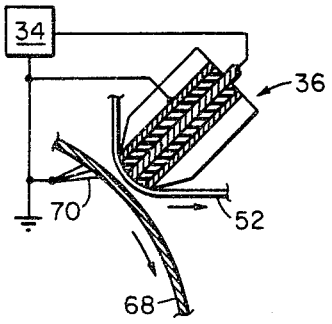
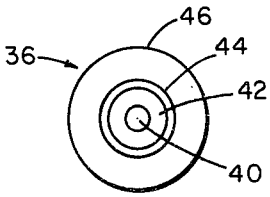
FIG. 3

STRUCTURED DONOR SHEET FOR HIGH-RESOLUTION NON-IMPACT PRINTER

RELATED APPLICATIONS

This application has been assigned to the same assignee as copending applications Ser. No. 710,282 entitled "Inks for Pulsed Electrical Printing and Methods of Producing Same", Ser. No. 710,280 and now U.S. Pat. No. 4,101,909 entitled "Magnetic Inking Apparatus for Pulsed Electrical Printing", and Ser. No. 710,281 and now U.S. Pat. No. 4,103,306 entitled "Non-Impact Printer with Magnetic Ink Reorientation", all filed on even date herewith, and Ser. No. 710,892 and now U.S. Pat. No. 4,087,826 entitled "Pulsed Electrical Printer with Dielectrically Isolated Electrode", filed Aug. 2, 1976 and incorporates the disclosures thereof by reference as hereinafter specifically noted.

BRIEF SUMMARY OF THE INVENTION

This invention relates generally to apparatus for pulsed electrical printing, as contrasted to mechanical impact and electrostatic printers. More particularly, the invention relates to donor sheets from which printing particles are selectively transferred to a recipient sheet for printing. Mechanical printers deliver ink to a recipient sheet by mechanical movement from a supply or donor sheet or strip. Electrostatic printers generally employ multi-step precedures involving sequential selective charging of surfaces and transfer of toner particles by electrostatic attraction. The present invention relates more directly to printers of the general type described in the U.S. Pat. to Robert W. Haeberle et al No. 3,550,153 dated Dec. 22, 1970.

The printing process of said patent consists generally in providing an electrically conductive ink, a receiving or recipient paper or sheet, and a means for producing an electric field of a predetermined shape to be printed, in pulses between the ink and paper. In a typical application this field may be in the order of 1000 volts across a gap of between 5 and 10 mils, this gap being measured from the ink through the thickness of the receiving sheet to the pulsed field shaping electrode. The ink or pigment is in mobile, particulate form. During the brief presence of the electric field, the ink particles on pinnacles are first charged by conduction of current from other particles closer to a supporting sheet, detached by the electric field, and then caused to transfer to the recipient paper by the force induced solely by the electric field. As described in said patent, the particles of conductive ink are initially deposited upon a surface of an ink support described as a donor sheet. In general, the amplitude and duration of the electric pulses must be so related as to cause an efficient transfer of sufficient ink for the required printing density, without causing an electrical breakdown or discharge between the electrodes. As described in said patent, the surface of the donor sheet closest to the recipient sheet includes electrically conductive particles of a printing material dispersed in a high resistance medium. The pulsed electrical field is applied to charge the printing particles selectively. The charged particles are subsequently transferred to the adjacent surface of the recipient sheet under the influence of the applied field. This is an efficient charging technique, whereby a charge is imparted to the printing particles in a very brief space of time. Because these conductive printing particles are dispersed in a high resistance medium, the electric field lines of the applied field become concentrated upon the conductive particles; thus these field lines tend to avoid the high resistance medium separating the conductive particles. The concentration of the field lines is a consequence of the concentration of induced charge upon these particles, and in addition it represents a focusing of lines of force upon the charged particles. The force on a particle depends on the electric field strength at the particle and the charge on the particle, being proportional to the product of the charge and the field strength. Both factors are increased when charge accumulates on a conductive particle, since the gathering of charge is accompanied by an increase in the density of field lines, which means an increase in the field strength, measured in lines per unit area.

In printers of the type described in said patent, with a non-homogeneous distribution of conductive particles in a poorly conducting medium, particularly a depth distribution which leaves groups of particles in mounds or towers, a printing pulse will charge preferentially those particles in preferred locations, such as the summits of mounds or towers, and these particles will be subjected to strong forces tending to detach them from their neighbors and transfer them from the donor sheet to the recipient sheet. In the practice of the printing technique described in said patent, the high resistance medium need not be a solid material, and in some cases it can be air. That is, if the donor sheet is properly constructed and inked, in such a way that the conductive pigmented particles and arranged in mounds and towers, the air surrounding and separating these mounds and towers can play the role of the poorly conducting medium in which the conductive particles are dispersed.

A donor sheet for non-impact printing, in which the poorly conducting medium is a solid dielectric composite material, is described in U.S. Pat. No. 3,833,409 to John Peshin, dated Sept. 3, 1974. This donor sheet is described as having a high lateral resistivity to aid in confining the printing to the immediate vicinity of the printing electrode face.

A further improvement upon the printing apparatus of said U.S. Pat. No. 3,550,153 is described in U.S. Pat. No. 3,898,674 to Paul L. Koch, dated Aug. 5, 1975. This patent describes a shield electrode that confines the printing field distribution more narrowly than would be possible with an unshielded printing electrode. It has been found that with the printing field distribution thus confined, satisfactory high resolution printing is obtained with a conductive base or support for the pigment particles, provided that the structure of the base or support and the arrangement of the pigment thereon are such as to produce a partial isolation of the conductive pigment particles into mounds and towers that are separated by a poorly conducting medium, such as air or a suitable solid material.

When the base material of the ink support is conductive, the hazard of electrical breakdown during the printing pulse is increased. This hazard can be reduced if the pulsed electrode is encapsulated within a dielectric material such as glass or a plastic such as Kapton, a polyimide sold by E. I. duPont de Nemours & Co., which in either case will withstand, without breakdown, extremely high electric field strength. As described in said application Ser. No. 710,892 entitled "Pulsed Electrical Printer with Dielectrically Isolated Electrode", the pulsed electrode can be recessed within the volume enclosed by a shield electrode, the remainder of this volume being filled by a dielectric material that can withstand without breakdown the high electric field generated by the printing pulses.

While the use of electrodes that are shielded and encapsulated permits the use of a conducting base layer, it is found that the use of a simple flat conducting base layer on which the pigment particles are spread in an unstructured flat and level coating will not provide satisfactory printing of adequately good intensity. It has been found that for satisfactory non-impact printing with such electrodes, the donor sheet is required to be structured in such a way that the field lines are focused selectively on individual conductive pigment particles. Accordingly, the principal object of this invention is to provide improved donor sheet structures and methods for their manufacture, which will produce improved print quality.

With the foregoing and other objects hereinafter appearing in view, this invention provides improvements upon the donor sheet structures disclosed in the above-mentioned patents and methods for their production. In particular, the improved donor sheet structures are adapted for use in conjunction with reinking printing machines such as those described in said applications Ser. Nos. 710,280 and 710,281, respectively entitled "Magnetic Inking Apparatus for Pulsed Electrical Printing" and "Non-Impact Printer with Magnetic Ink Reorientation". According to this invention, for example, the donor sheet may comprise a rigid drum or an endless belt. It may be coated with printing particles comprising a magnetizable material, and the base sheet itself may also comprise a magnetizable material.

A feature of this invention is that the donor sheet may be so constructed as to permit its use in conjunction with shield electrodes in a high-speed non-impact printer of the type generally described in said U.S. Pat. No. 3,550,153.

A structured donor sheet in accordance with this invention has a surface in which there are pockets and projections of microscopically small dimensions. These are part of the base layer, and increase its effective surface area and its ability to hold an irregular layer of ink particles. They also aid in the effectiveness of reinking, whereby the conductive printing particles are assembled into mounds and towers that serve as points of focus where the electric field lines of the printing pulses concentrate and act to charge and detach and transfer the conductive printing particles from the donor sheet to the recipient sheet.

A still further feature of the invention is the provision for conductive paths by which the conductive printing particles are rapidly charged by the electric field that is generated by the printing pulse. The conductive paths facilitate the charging process and thereby permit satisfactory printing at lower pulse voltage than the voltages needed when the charging paths have high resistance to the flow of the charging currents. When the printing electrodes are shielded as described in said U.S. Pat. No. 3,898,674, it is not necessary to have a base layer constructed of a high resistivity material. Indeed, conductive paths may be introduced on or in the base material, as long as the resulting donor sheet leaves the conductive printing particles in mounds and towers that project above the base layer so that the electric field lines will concentrate substantially upon the uppermost particles. Thus it is required that the structure of the donor sheet will cause the electric charge and the electric field lines to concentrate on selected conductive printing particles that will then be detached and transferred from the donor sheet to the recipient sheet, in the region of the recipient sheet that is outlined and defined by the shielded printing electrode.

BRIEF DESCRIPTION OF THE DRAWINGS

FIG. 1 is a partially schematic drawing of a pulsed electrical printer showing a donor sheet according to this invention, which is in the form of an endless belt having a base of high electrical resistance material.

FIG. 1A is a fragmentary drawing illustrating a variant of FIG. 1 in which the donor sheet is an endless metallic belt.

FIG. 2 is a partially schematic drawing of a pulsed electrical printer having a donor sheet according to this invention, which is in the form of a thin-walled rotating drum of high electrical resistance material.

FIG. 2A is a fragmentary view showing a variant of FIG. 2 employing a metallic rotating drum.

FIG. 3 is an end view of one form of print electrode used in each of the several illustrated embodiments.

DETAILED DESCRIPTION

Figure 4:
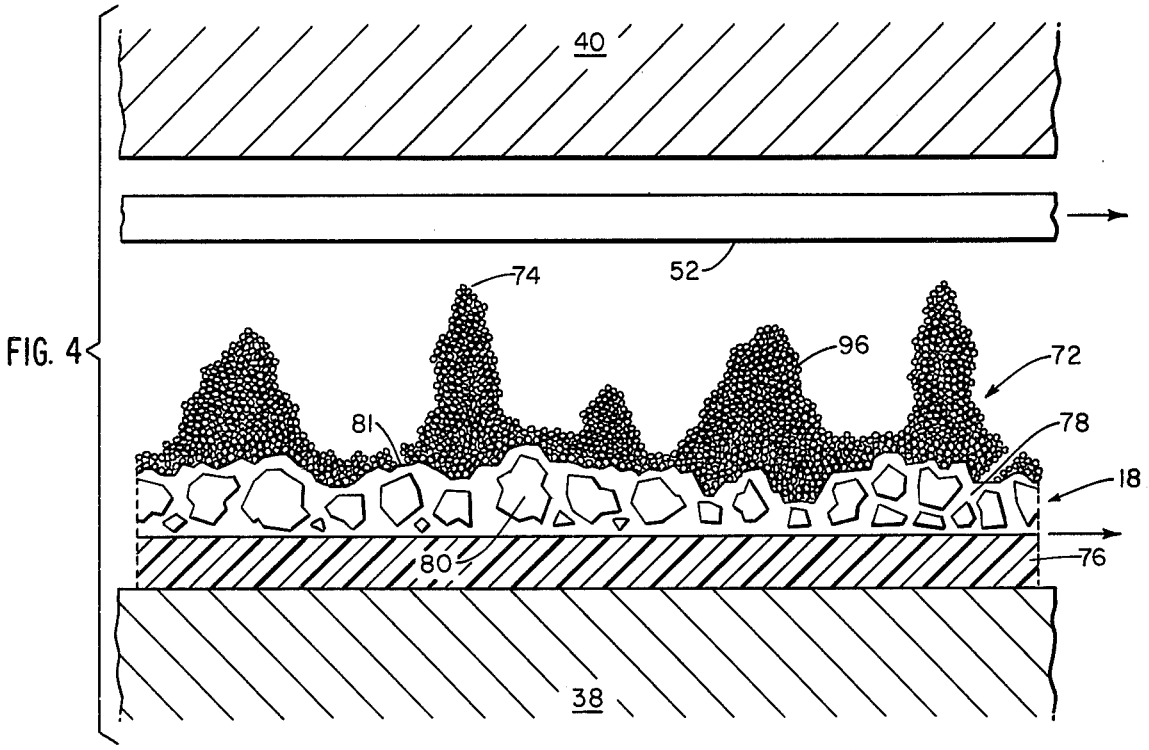
FIG. 4 is a cross section in elevation of a structured donor sheet according to the present invention.

FIG. 1 illustrates diagrammatically a pulsed electrical printer having a donor sheet constructed according to one form of this invention. The printer comprises a reinking station 12, a printing station 14, a fusing station 16, and other associated components as hereinafter described. An endless belt 18 of high electrical resistance material, having a roughened or microcavernous outer surface formed as hereinafter more fully described, is driven continuously by a drive motor 20. A hopper 22 deposits particulate printing particles 24 upon the surface of the belt, which in this embodiment then travel past a lower magnet 26, which may be a permanent magnet or an electromagnet energized by a variable source 28. Although a hopper has been shown in the drawing for illustration, any other suitable means for depositing particles may be used. In certain embodiments, an overhead magnet 30 may also be employed. The printing particles are preferably produced as described in said application entitled "Inks for Pulsed Electrical Printing and Methods of Producing Same" and in this embodiment contain magnetizable material. In the presence of the field of the magnet 26, the magnetizable printing particles deposited on the belt 18 form a rotating bead 32 from which a portion of the particles are peeled off and travel toward the printing station. Details of the operation of the reinking station 12 are described in said application Ser. No. 710,280 entitled "Magnetic Inking Apparatus for Pulsed Electrical Printing", and are incorporated herein by reference. As the belt 18 leaves the reinking station 12 the magnetizable conductive printing particles thereon are ordinarily distributed in mounds and towers.

In the printing station, a source 34 of brief electrical pulses applies such pulses selectively between one or more print electrodes 36 and a base electrode 38. For simplicity, only a single print electrode 36 has been illustrated, whereas a practical printer is provided with a plurality of electrodes and means for selectively energizing them, as described in said U.S. Pat. No. 3,898,674 and in U.S. Pat. No. 3,733,613 to Paul L. Koch et al dated May 15, 1973. Also, it will be understood that although the illustrated print electrode is shaped for printing a round dot as used in facsimile and dot matrix alphanumeric printers, other shapes of electrodes may be employed. As shown in FIGS. 1 and 3 and in accordance with the teachings of said U.S. Pat. No. 3,898,674, the electrode 36 comprises a metallic field shaping electrode 40, an electrically insulating material 42, a metallic shield electrode 44, and may include supporting body 46. By connections 48 and 50, the shield electrode and the base electrode are held at the same electrical potential.

By the action of brief electrical printing pulses between the field shaping electrode 40 and the base electrode 38, printing particles are transferred from the belt 18 to a web or sheet of ordinary untreated paper 52 passing from a supply roll 54 to a take-up roll 56. After the deposit of printing particles on the recipient paper 52, the latter passes through a fusing station 16 which provides sufficient heat to fuse the particles, thereby spreading them out and causing them to be more firmly attached to the paper. Details of the fusing step are given in said application Ser. No. 710,282 entitled "Inks for Pulsed Electrical Printing and Methods of Producing Same", and are incorporated herein by reference.

FIG. 1A illustrates a variant of the donor sheet construction of FIG. 1, in which the belt 18 is replaced by an endless belt 60 made of metal or other conductive material having a roughened or microcavernous surface. In this case a brush 62 or other equivalent means is connected with the source 34, whereby the belt 60 itself functions as a base electrode, thereby replacing the function of the electrode 38 in FIG. 1.

In the embodiments of FIGS. 1 and 1A, the printing station 14 is provided with a magnet 64 that is operable to reorient some of the mounds and towers of printing particles. More specifically, the field produced by this magnet is operable at locations of weakness in the particle chains comprising these towers, whereby the upper segments of certain of the towers are bent over. The bent-over segments are then no longer strong focal points on which the electric lines of force will gather, and there will be less charge drawn to such segments. The number of such segments that are detached and printed will be greatly reduced, and the printed regions will accordingly be less speckled in appearance, as fully described in said application Ser. No. 710,281 entitled "Non-Impact Printer with Magnetic Ink Reorientation", the description of which is incorporated herein by reference.

In the embodiment of FIG. 2, many of the elements are the same as those illustrated in FIG. 1. However, the donor sheet is shown in the form of a thin walled rotating drum 66 of high electrical resistance material which supports the printing ink particles. The outer surface of the drum 66 is microcavernous, providing sufficient frictional force to maintain the rotational movement within the bead 32. The inking station 12 contains, as in FIG. 1, the lower magnet 26 and the overhead magnet 30, establishing a magnetic potential well that restricts the forward motion of the bead 32. The inking station 12 also contains the hopper 22 with its reservoir of ink or pigment particles 25 by which the supply of particles in the bead 32 is replenished. The embodiment in FIG. 2 also includes the magnet 64, the function of which is the same as in FIG. 1.

The embodiment of FIG. 2A is similar to the embodiment of FIG. 2, except that the drum 66 is replaced by a drum 68 of metal or other electrically conductive material, and a brush 70 is connected to the source 34, whereby the drum 68 replaces the function of the base electrode 38.

FIG. 4 shows a cross section of the belt 18 of FIG. 1 with enlarged detail in the region of the field shaping electrode 40. In this embodiment the belt comprises a self-supporting sheet of high electrical resistance plastic with a resinous coating thereon constructed in accordance with the teachings of said U.S. Pat. No. 3,833,409, but with an additional step of metallization. The belt 18 comprises a reinforced or self-supporting sheet or film 76 of polyethylene terephthalate polyester. Upon the sheet 76 a coating 78 is formed as described in the last-mentioned patent. The coating 78 is formed by first making a mixture of coarse particles 80 of filler material of particle size between about 1 and 175 microns, such as silica sand, together with an insulating resin binder such as polyurethane and a solvent therefor. Preferably, the solvent comprises over 50 percent by volume of the total mixture and the resin content is between 5 and 60 percent by weight of the total weight of solids. This coating is applied to the sheet 76 and allowed to dry. This results in the formation of a microcavernous surface on the coating 78 with pits and peaks each about 0.5–50 microns across and 0.5–50 microns deep. The pits may also be described as pockets, crags or valleys. The peaks may also be described as projections or irregular mounds.

A thin layer 81 of conductive material is deposited in any suitable manner over the microcavernous surface of the coating 78 prior to depositing the print particles thereon. The presence of this metallized conductive layer greatly facilitates the charging of the print particles in the presence of printing pulses.

Instead of coating the printing particles 72 on the layer 81 by dispersing the particles in a volatile liquid as described in the last-mentioned patent, they are deposited as loose particles, as hereinabove described, as the belt 18 moves through the reinking station. These particles are subjected to the field of the magnets 26 and 30, this field extending from the surface of the layer 81 through the deposited particles 72. The field is so oriented and has sufficient magnitude to produce the bead 32 at the microcavernous surface of the layer 81, and this bead rotates about an axis substantially fixed relative to the field and extending laterally of the direction of motion of the belt 18, whereby a number of the particles in the bead are separated therefrom by frictional engagement with the sheet and remain coated thereon as mounds 96 and towers 74. Thus the particles, as coated, are in the form of spaced aggregates of irregular height.

The particles 72 preferably have a conductivity at least equal to that of a semi-conductor, and are preferably about 0.25–15 microns across. As coated on the belt 18, they are present in a quantity sufficient to effect printing by transfer to an adjacent recipient sheet upon the imposition of an electrical pulse of about 500 volts for 2 microseconds. After coating, the belt 18 has a lateral surface DC resistivity that may be materially less than 100,000 ohms per square; however, satisfactory printing is obtained using the shielded electrode of FIG. 1, or a recessed printing electrode with the surface thereof facing the sheet 52 being covered by a dielectric material as described in said application Ser. No. 710,892 entitled "Pulsed Electrical Printer with Dielectrically Shielded Electrode". Material improvements in the results were obtained by using a source 34 that produced a short train of pulses with alternating polarity when energizing the print electrode 36, thereby minimizing the likelihood that charge of one polarity might build up on the surface of the dielectric material.

In the embodiment of FIG. 2, the drum 66 comprises a suitable rigid plastic material which corresponds to the sheet 76 of FIG. 4. A coating similar to the coating 78 of FIG. 4 is applied to the surface of the drum in a manner similar to that described with reference to FIG. 1. A metallized layer similar to the layer 81 of FIG. 4 is also formed on the coating as described above.

As noted above, the possibility of electrical breakdown is materially reduced by the use of the shield electrode 44. Also, as described in the last-mentioned application, the inclusion of a dielectric shield on the face of the field shaping electrode 40 minimizes the chance of electrical breakdown. In either case, it becomes possible to have a donor sheet in which the base material is electrically conductive.

FIGS. 1A and 2A respectively show an electrically conducting web 60 and an electrically conducting drum 68. Each of these embodiments can be formed with a roughened or microcavernous surface thereon corresponding in structure to the surface of the coating 78 of FIG. 4. The surface may be prepared so as to leave it pitted and microcavernous by any of a wide variety of known methods which may be classified under the headings "coating", "surface roughening" and "conversion". In coating, a material is applied to the metal base sheet or drum. The coated material may be organic with particles of proper size in a binder. An example of the latter is the coating 78 with the metallization layer 81 described above. The coated material may be a metal applied by electrodeposition, chemical deposition, metal spraying or metallizing. Surface roughening may be accomplished by rapid etching or sandblasting, for example. Conversion of the surface of the metal base sheet or drum may be accomplished by forming an oxide or chromate or phosphate salts thereon. In any of these cases, the print particles are then coated upon the microcavernous surface by the inking station 12 in the manner described above.

In the embodiment of FIG. 4 and the other alternate methods described above, the microcavernous surface of the layer 78 preferably has a total area at least 1.4 times the area of the base sheet or film 76 that it covers. This latter area may be termed the projected area. Similar criteria apply to each of the other embodiments of the donor sheet described above.

The embodiment described above incorporate electrically conductive material in the donor sheet structure. The conductivity permits the rapid charging of the printing particles by the electric field which is generated by the printing pulse. Also, the conductive paths facilitate the charging process and thereby permit satisfactory printing at lower pulse voltages than the voltages needed when the charging paths have high resistance to the flow of the charging currents.

In each of the embodiments of the donor sheet described above, magnetizable material may be included in or on the base sheet. Thus, in the embodiments of FIGS. 1A and 2A, the drum itself may be constructed of a metal that is magnetizable as well as electrically conductive. A coating such as the coating 78 of FIG. 4 may be applied to the surfaces of the base materials, and some or all of the filler particles 80 may comprise magnetizable material; or such material may be incorporated into the body of a plastic base sheet or film 76. The presence of this magnetizable material is of particular value when a magnetizable material is included within the print particle, as described in said applications Ser. No. 710,282 entitled "Inks for Pulsed Electrical Printing and Methods of Producing Same" and Ser. No. 710,280 entitled "Magnetic Inking Apparatus for Pulsed Electrical Printing".

It will be apparent from the above description of the several embodiments of this invention that the particle distribution, as shown in FIG. 4, is such that there are many small groups of conductive printing particles protruding substantially above the average level of the top particles in the mounds and towers. Because these particles are conductive, and are in substantial contact with other conductive particles, the application of an electric potential between the shaped electrode 40 and the grounded base electrode 38 will produce a movement of charge among the conductive printing particles and will in particular charge strongly those particles on the peaks of the mounds and towers. If the base material in the donor sheet were composed only of an insulator or very highly resistive material the charge reservoir would be simply the layer of conductive printing particles themselves, so that an applied positive voltage pulse at the shaped electrode 40 would cause an upward movement of negative charge to the peaks of the mounds and towers, leaving the lowest particles in the layer charged positively. Similarly an applied negative pulse at the shaped electrode would cause an upward movement of positive charge to the peaks of the mounds and towers, leaving the lowest particles in the layer charged negatively.

If the base material in the donor sheet is made conductive through any of the several above-described procedures, the effect is to provide a further reservior of charge and to facilitate thereby the electrical charging of the conductive particles on the peaks of the mounds and towers.

As described above, the presence of an electrical print pulse results in the selective charging of individual particles on the peaks of mounds and towers. These particles are then subject to a very strong force in the applied electric field and are detached and transported from the donor sheet to the recipient sheet. This concentrtion of field lines is illustrated schematically in FIG. 5, where a tower 82 of conductive printing particles has been approximated by a cylindrical stack of disk-shaped segments. The top segment 84 thus represents the topmost particle in a tower of conductive printing particles. The distribution of the electric field produced by a printing pulse is represented by lines 86, and this distribution is such that the lines are strongly concentrated on the uppermost segment 84. The field is only weakly concentrated on the sides of lower segments such as 88, 90, 92 and 94. Furthermore, since each electrical line of force terminates normally to a conducting surface, it is apparent that only the top segment 84 is being pulled upwardly toward the electrode 40.

The distribution of field lines is also directly related to the distribution of surface charge on the conducting surfaces. In particular, the concentration of field line terminations on the top surface of the top cylindrical segment 84 indicates that there is at the same time a concentration of surface charges on this same top surface.

The upward force on the top segment 84 will be approximately equal to the product of the total charge on the top surface of this top segment, multiplied by the root-mean-square average of the electric field strength over this top surface. It is evident from FIG. 5 that this force on the topmost particle 84 in the tower 82 is very much greater, by perhaps two orders of magnitude, than the force on a particle that is one of many spread over a conducting base electrode in an unstructured thin layer of substantially uniform thickness.

Figure 5:
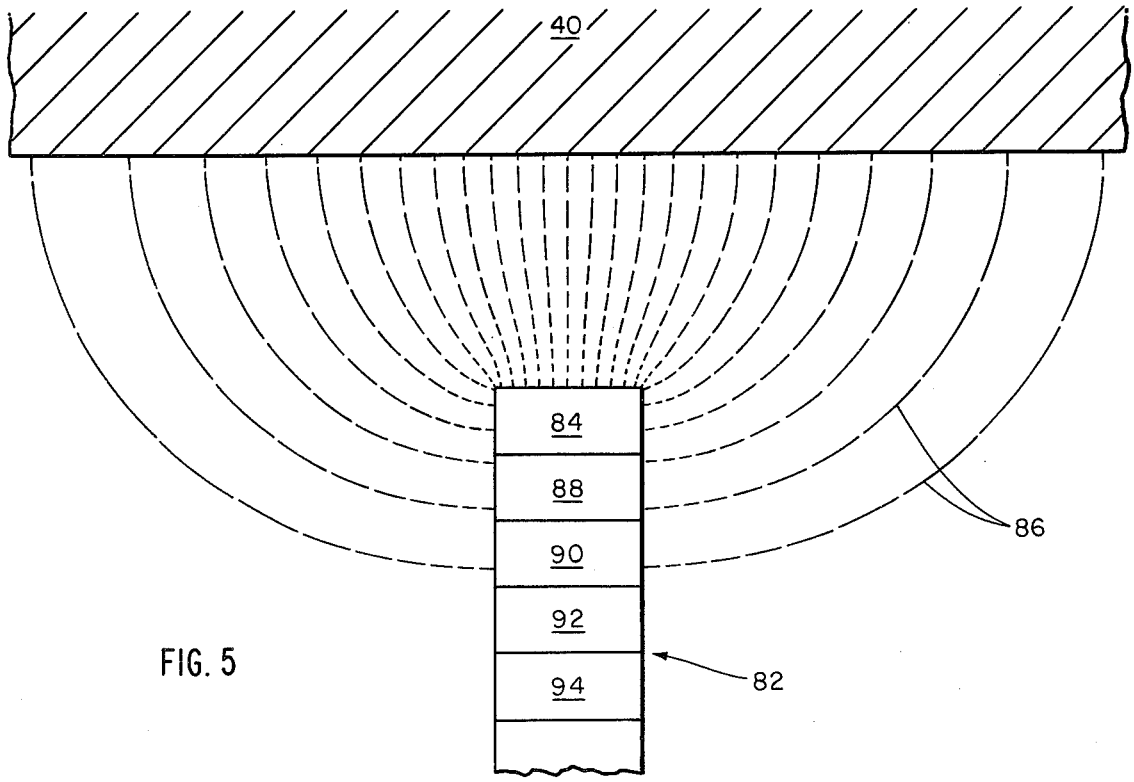
FIG. 5 is a diagram representing a tower of printing particles as a segmented cylinder, together with electric field lines for purposes of explanation.

When the strong force on the topmost segment in FIG. 5 has detached this segment and moved it upwardly and away from the remaining segments, there will be a flow of electrical current up the cylindrical stack until the distribution of electrical field lines and surface charges has been reconstituted in much the same form as is shown in FIG. 5. At this point, there will be a strong force over the top surface of the segment 88, which is now the topmost of the remaining segments. The strong force can now act to detach the segment 88 and to transport it upwardly toward the electrode 40.

While the field lines as represented in FIG. 5 are based on the idealization of a tower of particles as a stack of cylindrical disks, it will be evident that an actual tower of conductive printing particles formed in the manner hereinabove described, will behave in much the same way as the idealized stack. Thus referring to FIG. 4, the application of a voltage pulse to the electrode 40 will cause the topmost particle in the tower 74 to be strongly charged, and the associated concentration of field lines on this topmost particle will lead to a strong force tending to detach the particle and transport it upwardly to the recipient sheet. When this happens, it will be followed by a similarly strong charging of the next uppermost particle in the tower, and this may lead to its detachment and transfer. Whether one or more particles are actually printed will depend on the actual voltage level and the time duration of the printing pulse.

There will be a substantially similar concentration of field lines and surface charges upon conductive printing particles at and near the peaks of mounds such as 96. As in the case of the tower 74, the field concentration will provide a very strong force on the summit particles, causing them to be detached and transferred to the recipient sheet at pulse voltages which would not be sufficiently large to cause substantial printing if the particles were deposited in a flat, even layer on the base sheet.

We claim:

1. The method of producing a donor sheet for pulsed electrical printing comprising the steps of mixing coarse particles of filler 1–175 microns across in a solution of an organic insulating resin having a solvent content over 50% by volume and a resin content 5–60% by weight based on resin plus filler, coating said mixture onto a base sheet, drying said coating, thereby forming a microcavernous coating surface with pits and peaks each about 0.5–50 microns across and 0.5–50 microns deep, depositing conductive material over said microcavernous coating surface to form a microcavernous conductive surface, depositing loose uncharged print particles having a conductivity at least that of a semiconductor and comprising magnetizable material on said conductive surface while moving the sheet, subjecting said particles to a magnetic field extending from said conductive surface through the deposited particles while continuously moving the sheet and maintaining said field in an orientation and magnitude sufficient to produce a bead of said particles at said conductive surface rotating about an axis substantially fixed relative to said field and extending laterally of the direction of motion of the sheet, whereby a number of the particles in the bead are separated therefrom by frictional engagement with the sheet, and transporting the sheet away from said magnetic field with said separated uncharged particles remaining on the sheet loosely coated in said pits and as towers on said peaks in the form of spaced aggregates of irregular height.

2. The method of producing a donor sheet for pulsed electrical printing comprising the steps of imparting to a surface of a base sheet a microcavernous metallic surface with pits and peaks each about 0.5–50 microns across and 0.5–50 microns deep, depositing on said surface loose uncharged print particles, having a conductivity at least that of a semiconductor and comprising magnetizable material, while moving the sheet, subjecting said particles to a magnetic field extending from said surface through the deposited particles while continuously moving the sheet and maintaining said field in an orientation and magnitude sufficient to produce a bead of said particles at said surface rotating about an axis substantially fixed relative to said field and extending laterally of the direction of motion of the sheet, whereby a number of the particles in the bead are separated therefrom by frictional engagement with the sheet, and transporting the sheet away from said magnetic field with said separated uncharged particles remaining on the sheet loosely coated in said pits and on said peaks in the form of spaced aggregates of irregular height.

3. The method of producing a donor sheet for pulsed electrical printing comprising the steps of depositing a metal upon a base sheet so as to form thereon an irregular distribution of interconnecting microcrystals defining a microcavernous surface with pits and peaks each about 0.25–50 microns across and 0.25–50 microns deep, depositing on said surface loose uncharged print particles, having a conductivity at least that of a semiconductor and comprising magnetizable material, while moving the sheet, subjecting said particles to a magnetic field extending from said surface through the deposited particles while continuously moving the sheet and maintaining said field in an orientation and magnitude sufficient to produce a bead of said particles at said surface rotating about an axis substantially fixed relative to said field and extending laterally of the direction of motion of the sheet, whereby a number of the particles in the bead are separated therefrom by frictional engagement with the sheet, and transporting the sheet away from said magnetic field with said separated uncharged particles remaining on the sheet loosely coated in said pits and on said peaks in the form of spaced aggregates of irregular height.

4. The method according to claim 1, including the step of adding a magnetizable material to the base sheet before depositing the print particles thereon.

5. The method according to claim 2, including the step of adding a magnetizable material to the base sheet before imparting a microcavernous metallic surface thereto.

6. The method according to claim 3, including the step of adding a magnetizable material to the base sheet before depositing a metal thereon.

7. The method of producing a donor sheet for pulsed electrical printing comprising the steps of mixing coarse particles of filler 1–175 microns across in a solution of an organic insulating resin having a solvent content over 50% by volume and a resin 5–60% by weight based on resin plus filler, coating said mixture onto a base sheet, drying said coating, thereby forming a microcavernous coating surface with pits and peaks each about 0.5–50 microns across and 0.5–50 microns deep, depositing conductive material over said microcavernous coating surface, to form a microcavernous conductive surface, loosely depositing uncharged print particles having a conductivity at least that of a semiconductor in spaced irregular mounds and towers on said conductive surface.

8. The method of producing a donor sheet for pulsed electrical printing comprising the steps of roughening a surface of a metallic base sheet to make it microcavernous with pits and peaks each about 0.5–50 microns across and 0.5–50 microns deep, and loosely depositing uncharged print particles in spaced irregular mounds and towers on said surface.

9. The method of producing a donor sheet for pulsed electrical printing comprising the steps of depositing a metal upon a base sheet so as to form thereon an irregular distribution of interconnecting microcrystals defining a microcavernous surface with pits and peaks each about 0.5–50 microns across and 0.5–50 microns deep, and loosely depositing uncharged print particles in spaced irregular mounds and towers on said surface.

* * * * *